US007195310B2

(12) United States Patent
Reese

(10) Patent No.: US 7,195,310 B2
(45) Date of Patent: Mar. 27, 2007

(54) COLLAPSIBLE CHAIR WITH ADJUSTABLE BACKREST

(76) Inventor: Benjamin P Reese, 20777 Mountain Dr., San Jose, CA (US) 95120

( * ) Notice: Subject to any disclaimer, the term of this patent is extended or adjusted under 35 U.S.C. 154(b) by 0 days.

(21) Appl. No.: 11/121,989

(22) Filed: May 5, 2005

(65) Prior Publication Data

US 2006/0001295 A1 Jan. 5, 2006

Related U.S. Application Data

(63) Continuation-in-part of application No. 10/680,194, filed on Oct. 8, 2003, now abandoned.

(51) Int. Cl.
*A47C 4/00* (2006.01)

(52) U.S. Cl. ..... 297/19; 297/34; 297/35; 297/27; 297/28

(58) Field of Classification Search ..... 297/19, 297/22, 27, 28, 34, 35, 50, 48, 410, 440.21, 297/344.18
See application file for complete search history.

(56) References Cited

U.S. PATENT DOCUMENTS 2,512,353 A 6/1950 Magaldino et al.
4,514,009 A 4/1985 Vanderminden et al.
4,750,784 A 6/1988 Schwartz
4,881,776 A 11/1989 Wang
5,613,737 A * 3/1997 Tseng ..... 297/28
2003/0111873 A1 6/2003 Tseng

* cited by examiner

*Primary Examiner*—Anthony D. Barfield
(74) *Attorney, Agent, or Firm*—Birch, Stewart, Kolasch & Birch, LLP

(57) ABSTRACT

A chair includes a support assembly comprised of a first leg set having two space first bars and a second leg set having two space second bars located between and pivoted to the first bars. A backrest has is rotatable with respect to the support assembly to selectively change a tilting angle thereof. A tubular slide is movably fit over a free end of each first bar and is pivoted to the backrest. The slide has a fastening device to selectively secure the slide with respect to the first bar thereby releasably securing the backrest at a desired tilting angle. A wire and a spring are selectively connected between the slide and the first bar to prevent the slide from undesired separation from the first bar and to induce a returning force to move the backrest from a tilted position back to a regular position.

13 Claims, 9 Drawing Sheets

COLLAPSIBLE CHAIR WITH ADJUSTABLE BACKREST

This application is a Continuation-In-Part of application Ser. No. 10/680,194 filed on Oct. 8, 2003, now abandoned, the entire contents of which are hereby incorporated by reference and for which priority is claimed under 35 U.S.C. § 120.

BACKGROUND OF THE INVENTION

1. Field of the Invention

The present invention relates generally to a chair, such as a deck chair, and in particular to a collapsible chair having an adjustable backrest.

2. The Related Art

Chairs, such as deck chairs, that allow a person to sit and partially lie down on a backrest of the chair are known. Conventional deck chairs, although some featuring a folding or collapsible structure, have a fixed backrest that tilts at a fixed angle to allow a person to partially lie down. Such an angle is fixed and thus not adjustable. This may cause uncomfortable situations for different persons. In some designs of the deck chairs, the tilting angle of the backrest is too large to make a person comfortably lying thereon. It may sometimes cause troubles to the old to get up from the excessively tilting backrest or even fall down over the backside of the chair.

Deck chairs with adjustable backrest are also known. The adjustable backrest allows a user to change the tilting angle of the backrest, usually from a regular, substantially upright position to a tilted position, which forms a much larger included angle with respect to the vertical. Manual operation is often required to move the backrest from the regular position to the tilted position. Manual operation is also required to move the backrest back to the regular position. This causes troubles to for example the aged user, because the user must bend down to have his or her hands reach the titled backrest that is located lower.

In addition, some adjustable designs of the chair backrest involve sliding movement between two sections of extendible armrest of the chair. Over tilting of the backrest may cause damage to and simply and undesirably separate the sections of the armrest.

Thus, it is desired to have a collapsible chair with an adjustable backrest that effectively eliminates the drawbacks encountered in the conventional designs of the collapsible chairs.

SUMMARY OF THE INVENTION

A primary objective of the present invention is to provide a collapsible chair having an adjustable backrest comprising an automatic returning mechanism that allows for easy returning of the backrest to a regular position.

Another objective of the present invention is to provide a collapsible chair having a safety mechanism that prevents undesired over tilting of an adjustable backrest of the chair.

To achieve the above objectives, in accordance with the present invention, there is provided chair comprising a support assembly comprised of a first leg set having two space first bars and a second leg set having two space second bars located between and pivoted to the first bars. A backrest has is rotatable with respect to the support assembly to selectively change a tilting angle thereof. A tubular slide is movably fit over a free end of each first bar and is pivoted to the backrest. The slide has a fastening device to selectively secure the slide with respect to the first bar thereby releasably securing the backrest at a desired tilting angle. A wire and a spring are selectively connected between the slide and the first bar to prevent the slide from undesired separation from the first bar and to induce a returning force to move the backrest from a tilted position back to a regular position.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
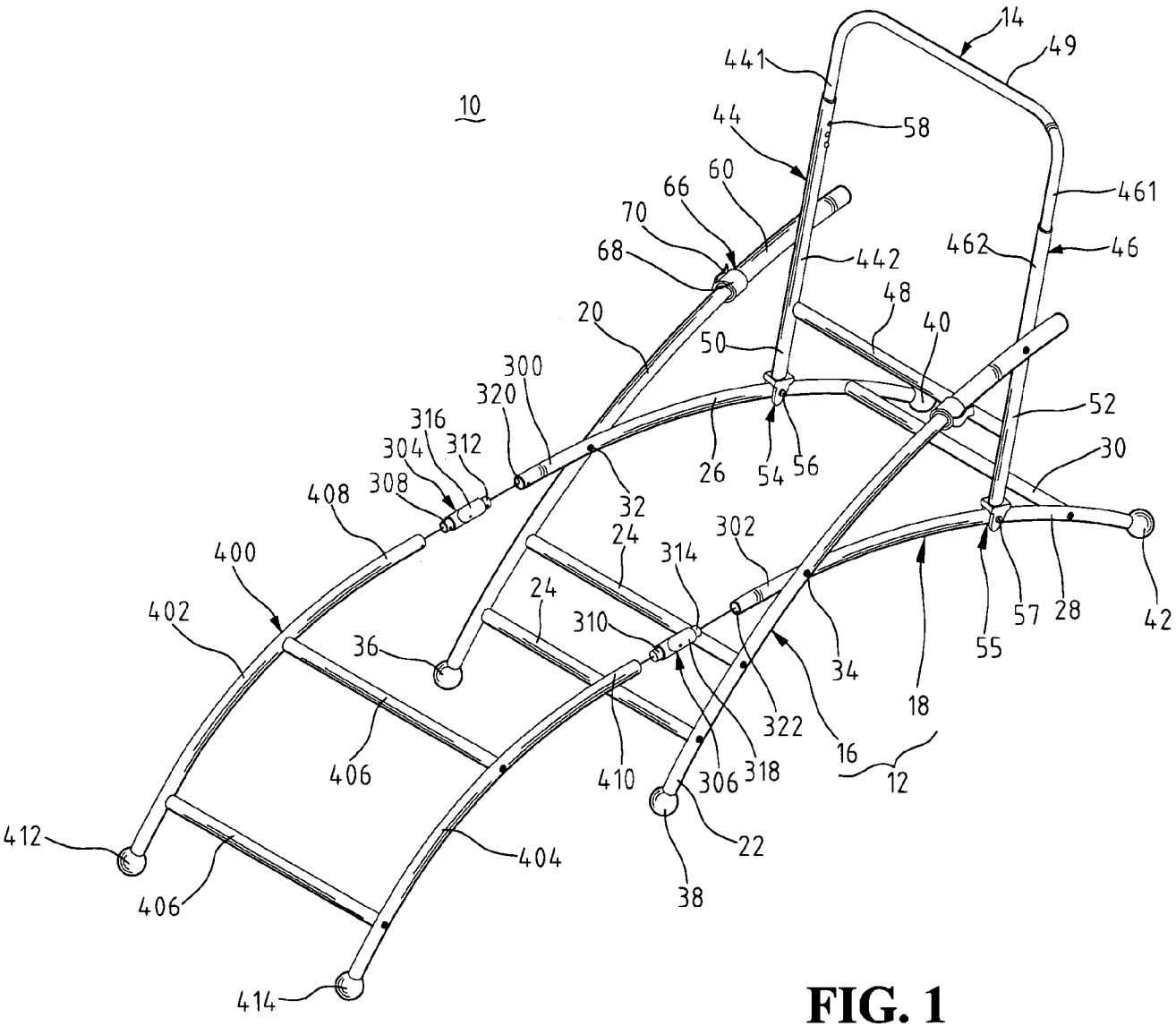
FIG. 1 is a perspective view of a collapsible chair constructed in accordance with the present invention, with a leg support detached from the chair.
Figure 2:
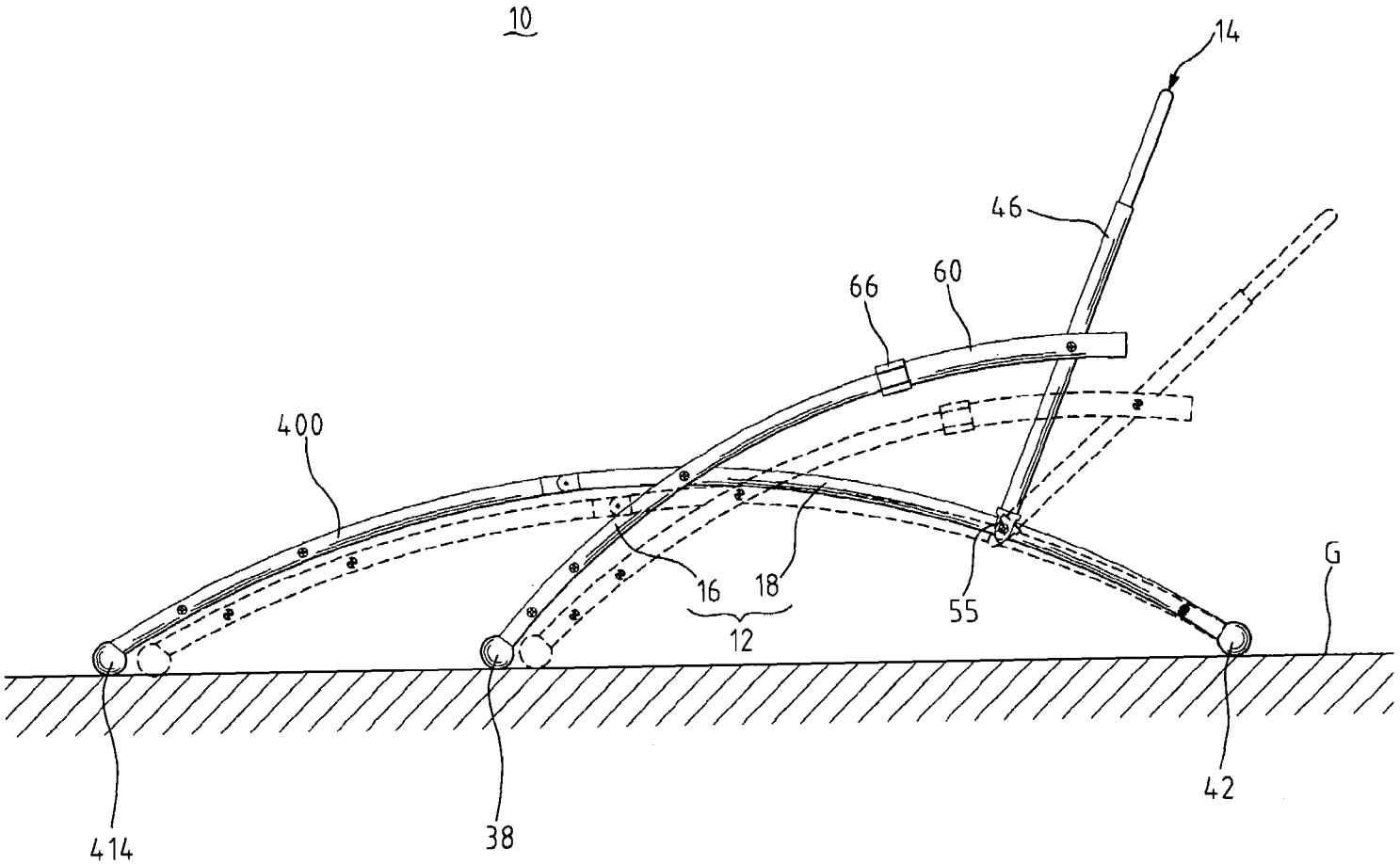
FIG. 2 is a side elevational view of the collapsible chair of the present invention, wherein solid lines show a regular position of a backrest of the chair, while phantom lines indicate a tilted position.

With reference to the drawings and in particular to FIGS. 1 and 2, a collapsible chair constructed in accordance with the present invention, generally designated with reference numeral 10, comprises a support assembly 12 and a backrest 14 movably mounted to the support assembly 12 whereby the backrest 14 selectively tilts with respect to the support assembly 12 at a tilting angle which is adjustable.

The support assembly 12 comprises a front leg set 16 and a rear leg set 18 pivoted to each other. The front leg set 16 comprises two front bars 20, 22 spaced from and substantially parallel to each other. The front bars 20, 22 are fixed together by front crossbars 24 extending therebetween. Although in the embodiment illustrated, two front crossbars 24 are used to fix the front bars 20, 22 together, other numbers of front crossbars may also be used. For example, the front bars 20, 22 can be fixed together by a single front crossbar.

Figure 3:
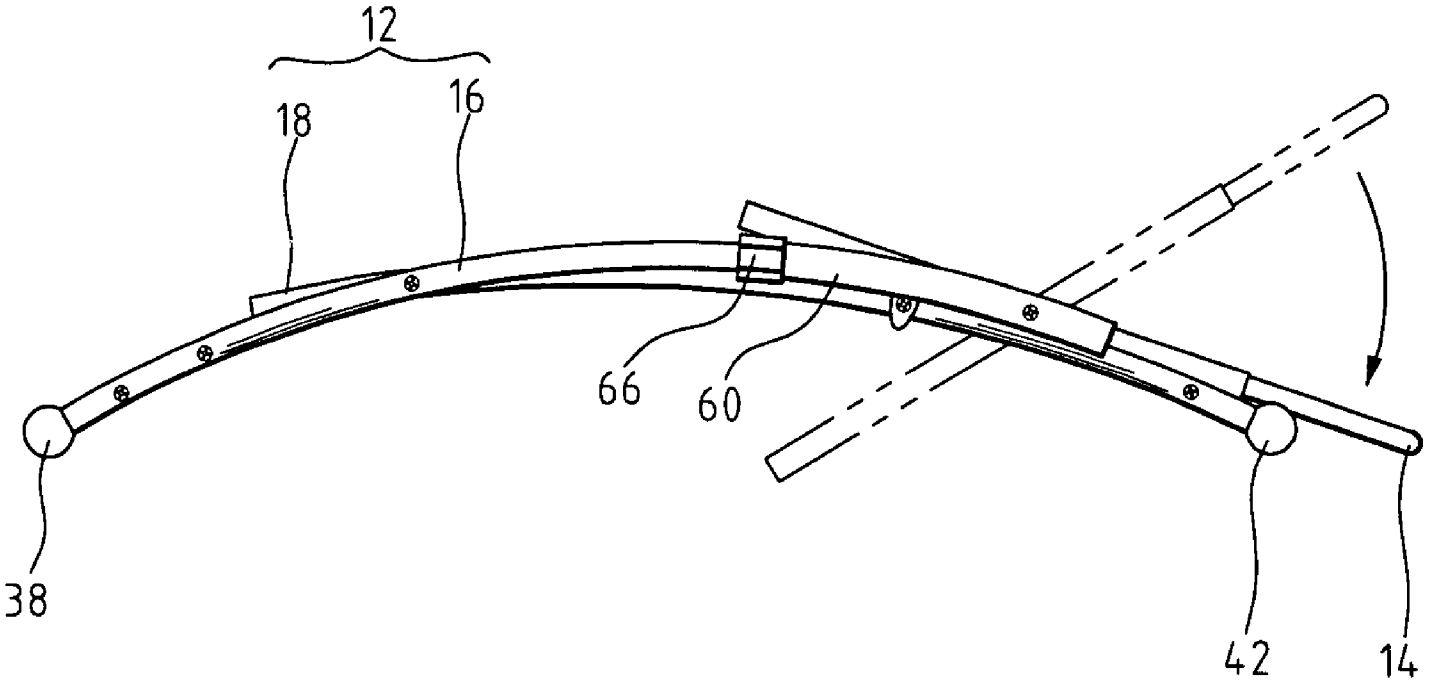
FIG. 3 is also a side elevational view of the collapsible chair of the present invention in a collapsed condition, with the leg support omitted for simplicity.

The rear leg set 18 comprises two rear bars 26, 28 spaced from and substantially parallel to each other. The rear bars 26, 28 are fixed together by a rear crossbar 30 extending therebetween. Although in the embodiment illustrated, a single rear crossbar 30 is used to fix the rear bars 26, 28 together, other numbers of rear crossbars may also be used. For example, the rear bars 26, 28 are fixed together by two or more rear crossbars. The front and rear crossbars 24, 30 are of such lengths that the rear leg set 18 is received between the front bars 20, 22 of the front leg set 16 with the rear bars 26, 28 adjacent to the front bars 20, 22 whereby pivot pins 32, 34 extends through the rear bars 26, 28 and the associated front bars 20, 22 to pivot the rear leg set 18 to the front leg set 16, whereby the front leg set 16 and the rear leg set 18 are allowed to rotate with respect to each for collapsing and expanding. This allows the chair 10 to move between an expanded condition, as shown in FIGS. 1 and 2, and a collapsed position as shown in FIG. 3.

Each of the front and rear bars 20, 22, 26, 28 has an end 36, 38, 40, 42 positionable on a fixture surface, such as the ground G (see FIG. 2), for supporting the chair 10 on the ground G. In the embodiment illustrated, the end 36, 38, 40, 42 has an expanded portion for soundly supporting the chair 10. Preferably, the expanded portion is spherical, as illustrated in the drawings, which helps to protect the fixture surface that may be constituted by wood or other material that can be damaged by sharp edges of the ends 36, 38, 40, 42.

Each rear bar 26, 28 has an opposite end 300, 302 that is opposite to the lower end 40, 42 with respect to the pivot pin 32, 34 between the front leg set 16 and the rear leg set 18. A connector 304, 306, which is comprised of a front section 308, 310 and a rear section 312, 314 rotatably jointed to each other by a pin 316, 318, is mounted to each end 300, 302 of the rear bar 26, 28. In the embodiment illustrated, the end 300, 302 forms a bore 320, 322 into which the rear section 312, 314 of the connector 304, 306 is fit. The connector 304, 306 can be mounted to the rear bar 26, 28 in a removable manner, such as by friction between the rear end of the connector 104, 106 and the bore of the end 100, 102 of the rear bar 26, 28. Alternatively, spring-biased-pin-and-hole pair can be employed to removably secure the connector 304, 306 to the rear bar 26, 28.

A leg support 400 comprises two extension bars 402, 404 spaced from and substantially parallel to each other. The extension bars 402, 404 are fixed together by two crossbars 406, forming a rigid frame structure. The crossbars 406 are of a length substantially corresponding to that of the rear crossbar 30, whereby the extension bars 402, 404 respectively correspond to the rear bars 26, 28. Each extension bar has a first end 408, 410 and an opposite second end 412, 414. The first end 408, 410 is removably coupled to the respectively connector 304, 306 by for example having the front section 308, 310 of the connector 304, 306 frictionally fit into bores (not shown) defined in the first end 408, 410 of the extension bar 402, 404. This allows the leg support 400 to be selectively removed from the chair 10.

The second ends 412, 414 of the extension bars 402, 404 are adapted to be positioned on the ground G as illustrated in FIG. 2. Preferably, the second ends 412, 414 form spherical or rounded expansion for stable and protective ground contact.

In the embodiment illustrated, the front and rear bars 20, 22, 26, 28 and the extension bars 402, 404 are of convex arc configurations. This allows for a comfortable and sound support to the body and the legs of a person sitting thereon. The arc configuration of the front bars 20, 22 also allows for the formation of armrests by portions of the front bars 20, 22 between the backrest 14 and the pivot joints 32, 34 of the front bars 20, 22 with respect to the rear bars 26, 28.

The backrest 14 comprises two back bars 44, 46 spaced from and substantially parallel to each other. The back bars 44, 46 are fixed together by back crossbars 48, 49 extending therebetween. The back crossbars 48, 49 are so arranged that the back crossbars 48, 49 and the back bars 44, 47 form a rectangle with lower end sections 50, 52 of the back bars 44, 47 extending beyond the lower back crossbar 48. The back crossbars 48, 49 have a length substantially corresponding to the length of the rear crossbar 30 so that the lower end sections 50, 52 of the back bars 44, 46 are respectively in alignment with the rear bars 26, 28 of the rear leg set 18.

A joint member 54, 55 is formed on the lower end section 50, 52 of each back bar 44, 46 of the backrest 14. The joint member 54, 55 comprises a pivot 56, 57 to pivotally attach the joint member 54 to the rear bar 26, 28. The pivot joint 56, 57 between the backrest 14 and the rear leg set 18 allows the backrest 14 to selectively tilt or lean with respect to the support assembly 12 at a tilting angle that is adjustable through rotation of the backrest 14 with respect to the support assembly 12.

Each back bar 44, 46 has a telescopic construction comprising an inner tube 441, 461 telescopically received in an outer tube 442, 462. A pin (not labeled) is arranged in the inner tube 441, 461 and is resiliently biased to extend beyond the inner tube 441, 461 to engage holes 58 defined in the outer tube 442, 462 thereby selectively securing the position of the inner tube 441, 461 with respect to the outer tube 442, 462. This provides the backrest 14 with an adjustable size by means of the telescopic displacement of the inner tubes 441, 461 with respect to the outer tubes 442, 462. Preferably, the upper back crossbar 49 is integrally formed with the inner tubes 441, 461 to form a U-shaped configuration, while the lower back crossbar 49 is mounted between the outer tubes 442, 462.

The front leg set 16 comprises a tubular slide 60 having an end fit over a free end section (not labeled) of each front bar 20, 22 that is opposite to the expanded end 36, 38. The tubular slide 60 telescopically receives the free end section of the front bar 20, 22 therein and movable along and with respect to the free end section to change relative position therebetween. The tubular slide 60 is pivoted to the corresponding back bar 44, 46 of the backrest 14 for selectively imposing constraints to the rotation of the backrest 14 with respect to the support assembly 12. Fastening means 66 is provided between the tubular slide 60 and the front bar 20, 22 for selectively securing the tubular slide 60 with respect to the front bar 20, 22 thereby fixing the backrest 14 with respect to the support assembly 12.

In the embodiment illustrated, the fastening means 66 comprises a collar 68 mounted to the tubular slide 60, comprising deformable paws (not shown), which when actuated by an operation level 70, impose a sufficient friction force to the respective front bar 20, 22 thereby securing the tubular slide 60 with respect to the front bar 20, 22. The friction based fastening means is generally known to those having ordinary skills and thus no further details will be given herein. It is also noted that such a friction based fastening means can be replaced by other known fasteners, such as spring-biased pins.

Figure 4:
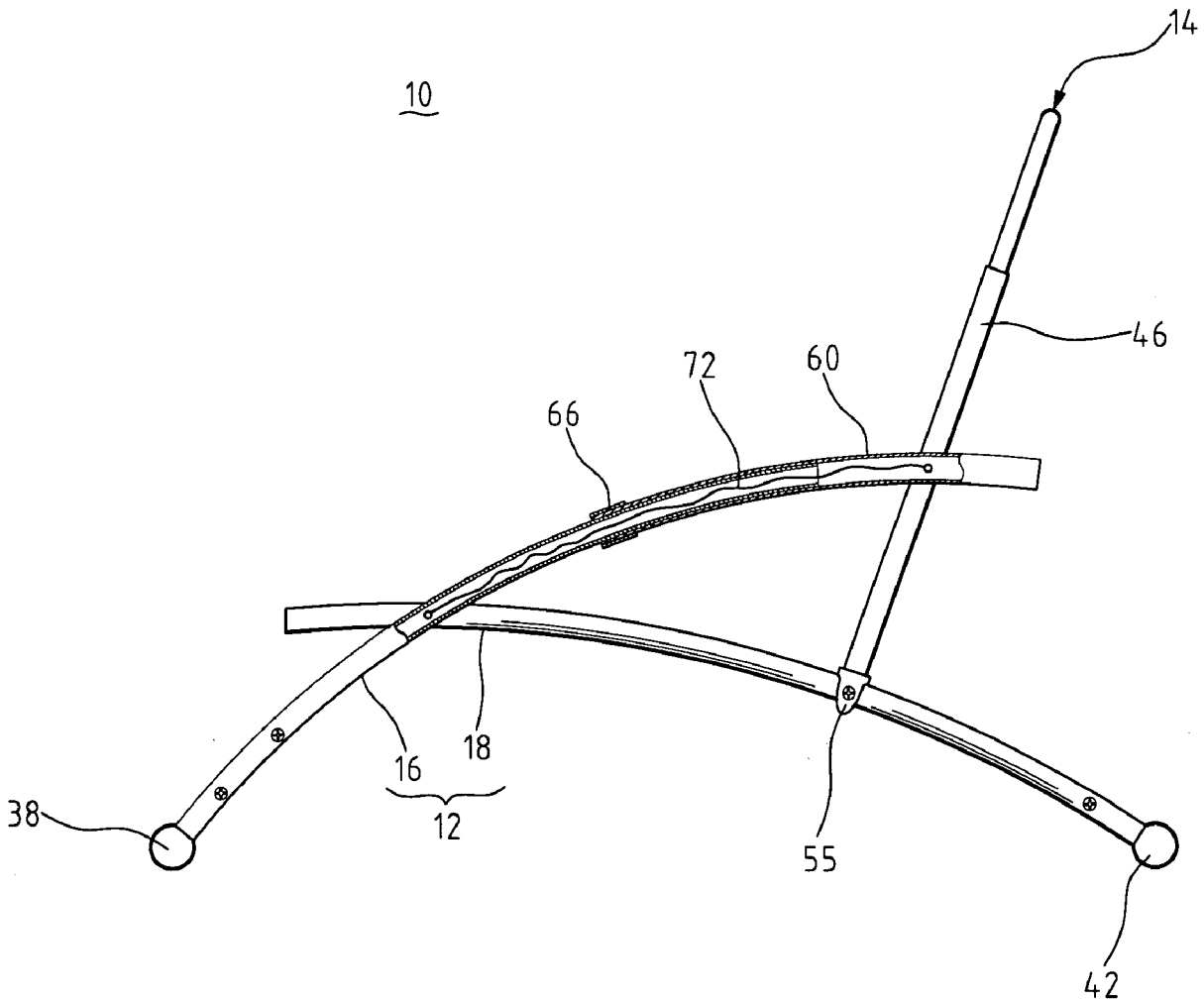
FIG. 4 is a side elevational view of the collapsible chair of the present invention with the backrest at the regular position, an armrest of the chair being partially broken to show a safety/automatic-returning mechanism in accordance with a first embodiment of the present invention.
Figure 5:
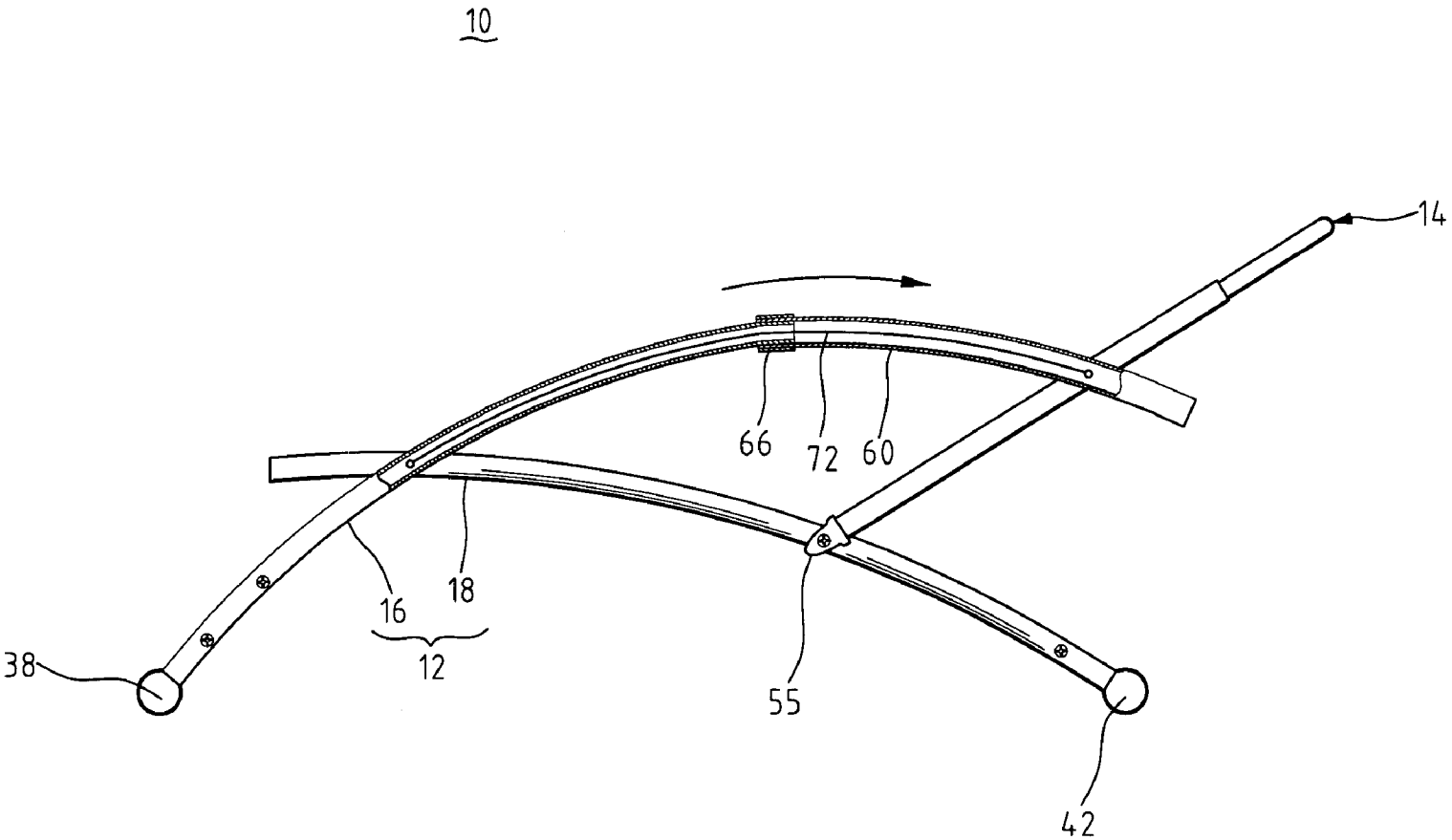
FIG. 5 is similar to FIG. 4, but showing the backrest of the chair at the tilted position.

Also referring to FIGS. 4 and 5, flexible connection means, such as a wire 72, is arranged inside the tubular slide 60 and has opposite ends (not labeled) attached to the tubular slide 60 and the front bar 20, 22, respectively. The wire 72 has a length that is shorter than a maximum length of the end section 62 of the front bar 20, 22 that can be received into the tubular slide 60 whereby the tubular slide 60 is prevented from sliding off the front bar 20, 22 by the wire 72.

The pivotal joint between the backrest 14 and the support assembly 12, and that between the front leg set 16 and the rear leg set 18 of the support assembly 12, as well as the sliding joint between the slides 60 and the front bars 20, 22 allow the chair 10 to be collapsed from the expanded condition (FIGS. 1 and 2) to the collapsed position (FIG. 3). The collapse of the chair 10 is easily carried out by releasing the fastening means 66 to allow the tubular slides 60 to move to a furthest location with respect to the front bars 20, 22, which rotates the backrest 14 with respect to the support assembly 12 about pivot pins 56. The furthest location is determined by the length of the wire 72, which is such that the backrest 14 substantially overlies on the back leg set 18 and the front and back leg sets 16, 18 substantially coincident with each other as illustrated in FIG. 3, thereby completing the collapse of the chair 10.

The rotation of the backrest 14 with respect to the support assembly 12 also allows the backrest 14 to change the tilting angle thereof. This is demonstrated by the phantom lines of FIG. 2. By releasing the fastening means 60 to allow sliding of the slide 60 with respect to respective front bar 20, 22, with the aid of the rotatable joints between the backrest 14 and the support assembly 12, the backrest 14 is moved from a regular position as indicated by solid lines in FIG. 2 to a tilted position indicated by phantom lines of FIG. 2. The fastening means 60 can secures the slide 60 at any desired position along the front bar 20, 22 thereby allowing for arbitrary adjustment of the tilting angle of the backrest 14 with respect to the support assembly 12.

FIGS. 4 and 5 respectively show the regular position and the tilted position of the backrest 14 of the chair 10. The connection means, which is a wire 72 in this case, is stretched from a slack condition to a taut condition. The wire 72 gets extremely taut when the backrest 14 reaches a collapsed condition.

Figure 6:
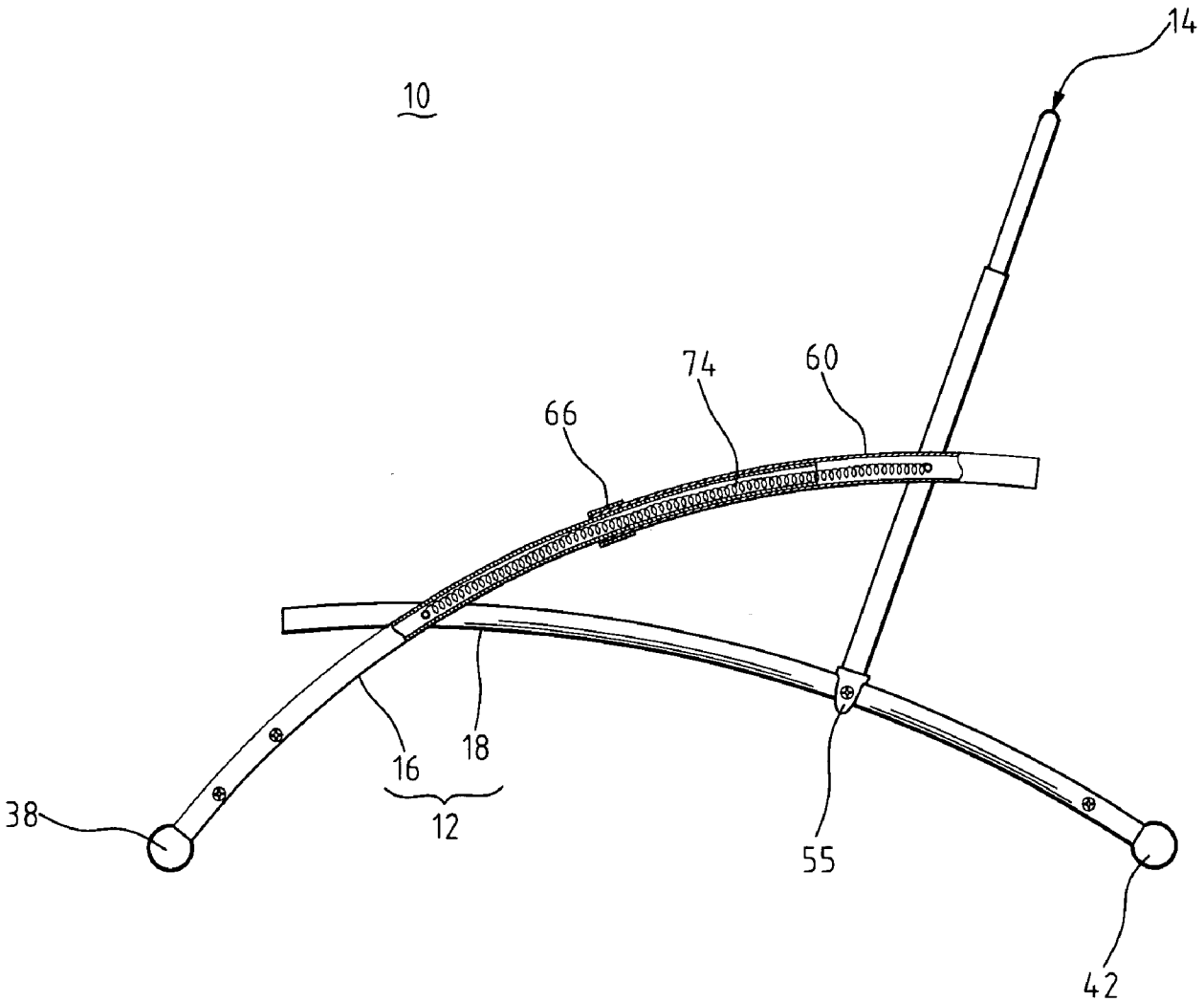
FIG. 6 is a side elevational view of the collapsible chair of the present invention with the backrest at the regular position, an armrest of the chair being partially broken to show a safety/automatic-returning mechanism in accordance with a second embodiment of the present invention.
Figure 7:
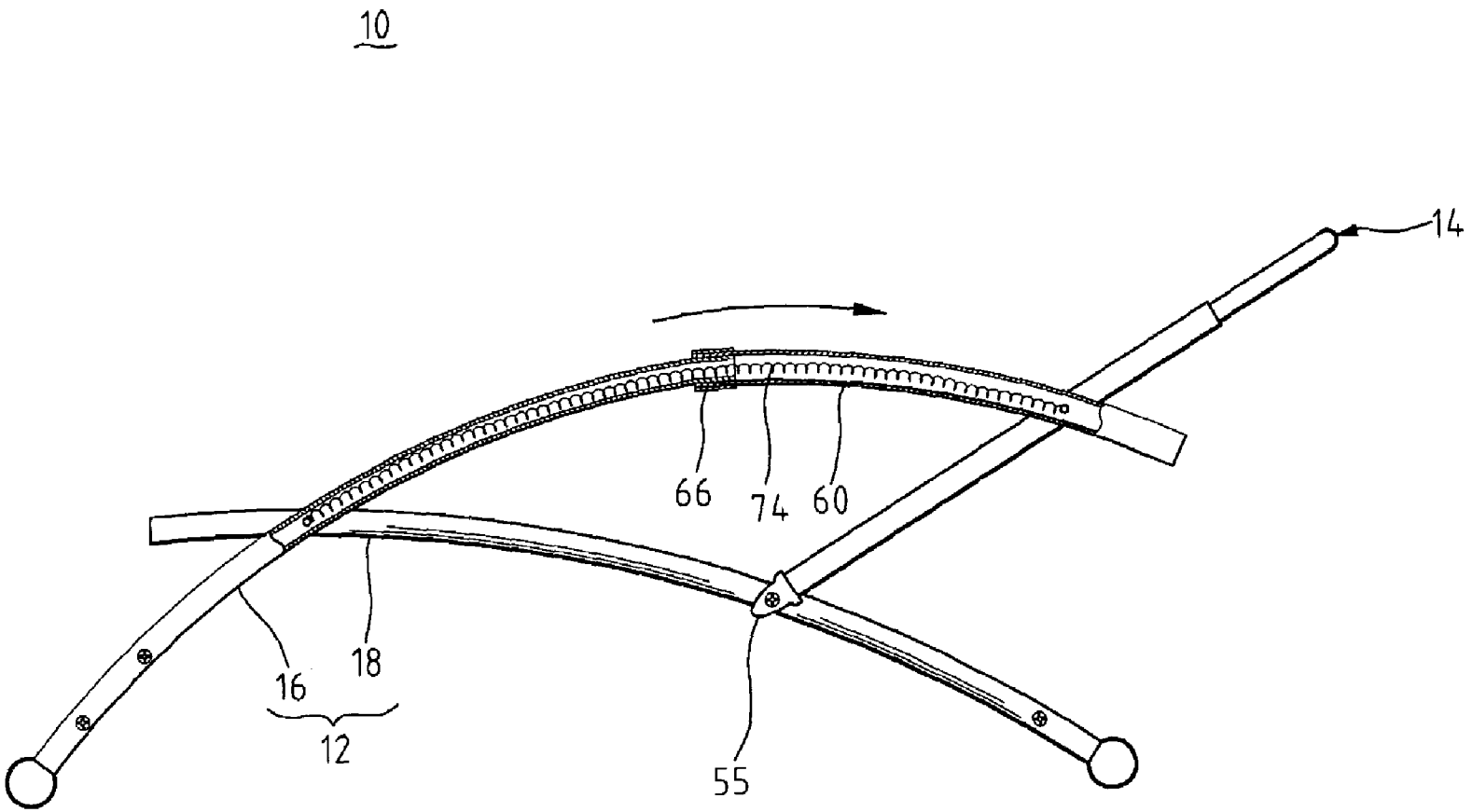
FIG. 7 is similar to FIG. 6, but showing the backrest of the chair at the tilted position.

If desired, the connection means can be made elastically extendible, such as using a resilient member, for example a helical spring 74, to replace the wire 72, as shown in another embodiment illustrated in FIGS. 6 and 7. The resilient member 74 induces a tensile force with the sliding movement of the slide 60 with respect to the front bar 20, 22 from the regular position to the tilted position, as shown in FIG. 7. In an attempt to return the backrest 14 from the tilted position (or the collapsed position) to the regular position, the tensile force induced in the resilient member 74 helps to move the slide 60 along the front bar 20, 22 to the regular position. Apparently, the wire 72 that is illustrated in the embodiment of FIGS. 4 and 5 serves to prevent the slide 60 from separation from the front bar 20, 22, while the helical spring 74 helps returning the backrest 14 to the regular position.

Figure 8:
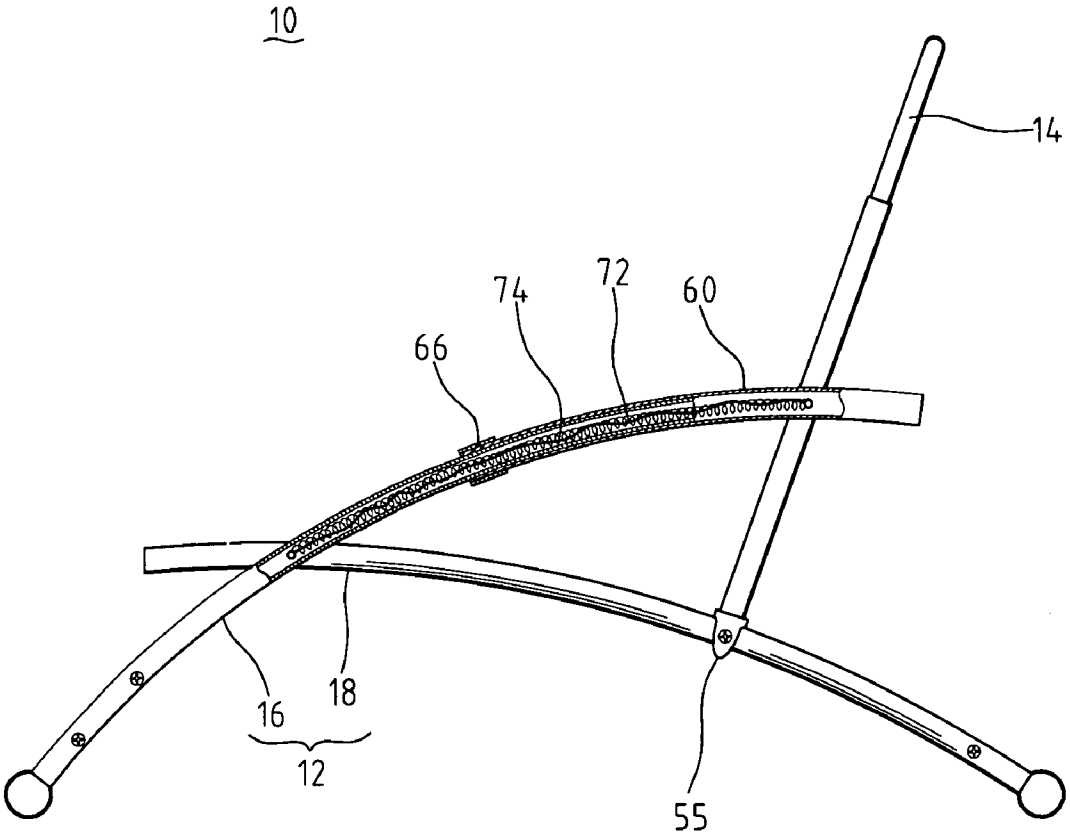
FIG. 8 is a side elevational view of the collapsible chair of the present invention with the backrest at the regular position, an armrest of the chair being partially broken to show a safety/automatic-returning mechanism in accordance with a third embodiment of the present invention.
Figure 9:
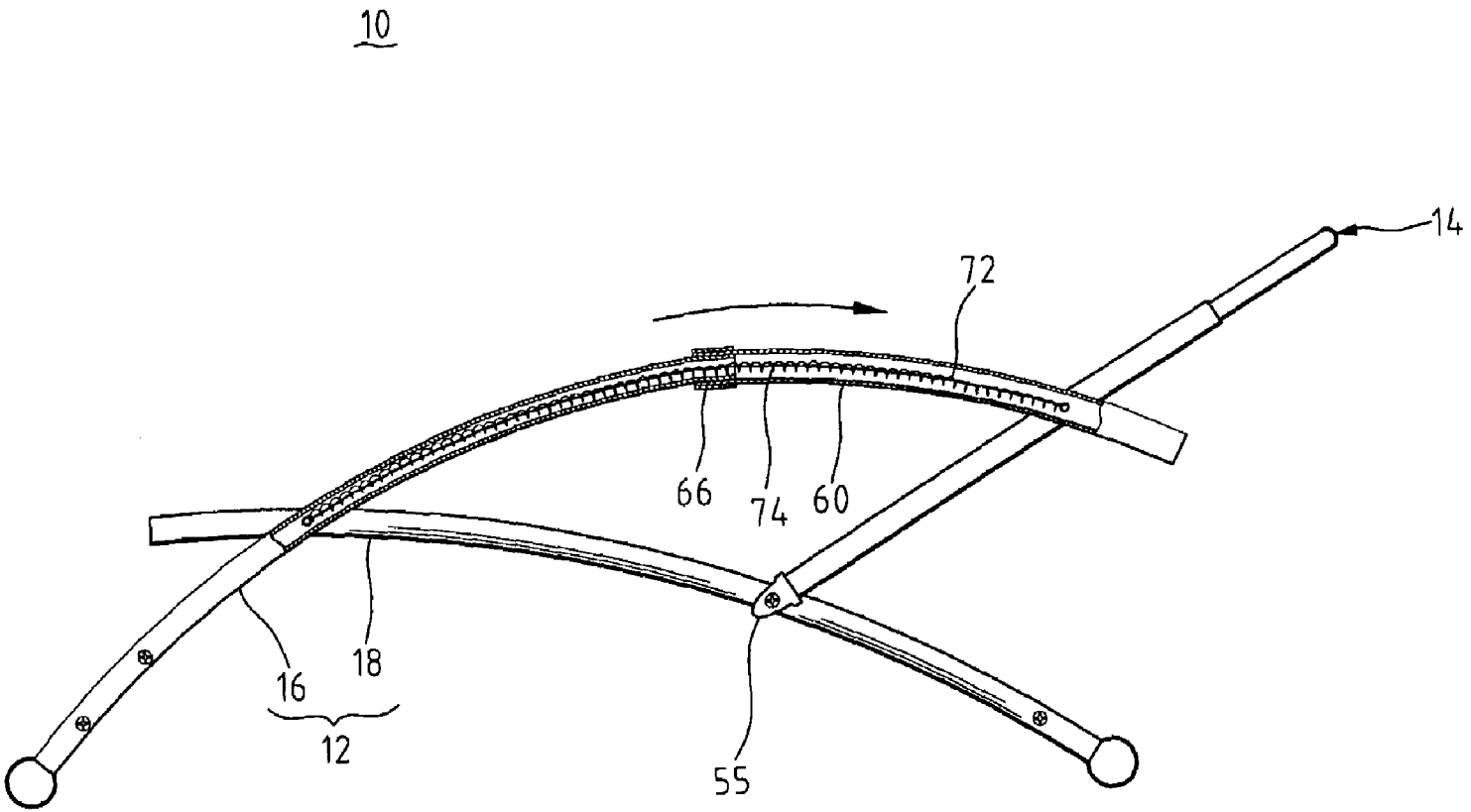
FIG. 9 is similar to FIG. 8, but showing the backrest of the chair at the tilted position.

If desired, both a wire 72 and a resilient member 74 can be arranged between the slide 60 and the respective front bar 20, 22 as illustrated in a further embodiment of the present invention shown in FIGS. 8 and 9, whereby undesired separation of slide 60 from the respectively front bar 20, 22 is prevented by the wire 72, while returning of the backrest 14 back to the regular position is enhanced by the resilient member 74.

It is noted that the leg support 400 is omitted in FIGS. 4–9. As mentioned previously, the leg support 400 is removably connected to the support assembly 12 of the chair 10 by the connectors 304, 306. This allows a user to selectively remove the leg support 400.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A chair comprising:

a support assembly comprising legs adapted to position on a fixed surface;

a backrest having lower ends pivoted to the support assembly whereby the backrest is rotatable with respect to the support assembly to selectively change a tilting angle of the backrest with respect to the support assembly;

a slide movably fit over a portion of the support assembly and pivoted to the backrest, the slide further comprising fastening means to selectively secure the slide with respect to the support assembly thereby releasably securing the tilting angle of the backrest with respect to the support assembly; and extendible means connecting between the slide and the portion of the support assembly, to induce a force to the slide with the movement of the slide with respect to the portion of the support assembly;

wherein the extendible means comprises a resilient member that induces a tensile force with the movement of the slide from a first position to a second position when the backrest is rotated to change the tilting angle thereof from an original angular position to a destination angular position and wherein the tensile force helps returning the slide from the second position to the first position when the backrest is moved from the destination angular position to the original angular position.

2. The chair as claimed in claim 1, wherein the resilient member comprises a helical spring.

3. The chair as claimed in claim 2, wherein the portion of the support assembly comprises a bar having a free end and wherein the slide comprises a tubular section slidably fit over the free end of the bar, the helical spring having opposite ends respectively fixed to the bar of the support assembly and the tubular section of the slide.

4. The chair as claimed in claim 1, wherein the extendible means further comprises a flexible wire connected between the slide and the portion of the support assembly, the wire having a predetermined length to prevent the slide from separation from the portion of the support assembly.

5. The chair as claimed in claim 4, wherein the resilient member comprises a helical spring.

6. The chair as claimed in claim 5, wherein the portion of the support assembly comprises a bar having a free end and wherein the slide comprises a tubular section slidably fit over the free end of the bar, the helical spring having opposite ends respectively fixed to the bar of the support assembly and the tubular section of the slide, the wire having opposite ends respectively fixed to the bar of the support assembly and the tubular section of the slide.

7. The chair as claimed in claim 1 further comprising a leg support removably attached to the support assembly.

8. The chair as claimed in claim 1, wherein the support assembly comprises a first leg set comprising two spaced first leg bars, and a second leg set comprising two spaced second leg bars located between and pivoted to the first leg bars.

9. The chair as claimed in claim 8, wherein the slide comprises a tubular section slidably fit over an extended free end of each second leg bar, and wherein the extendible means comprises a wire of predetermined length that prevents the slide from separation from the extended free end and a helical spring that induces a tensile force, which after the backrest is moved from a first angular position to a second angular position, enhances returning of the backrest from the second angular position back to the first angular position, both the wire and the helical spring having opposite ends attached to the slide and the extended free end respectively.

10. A chair comprising:

a support assembly comprising legs adapted to position on a fixed surface;

a backrest having lower ends pivoted to the support assembly whereby the backrest is rotatable with respect to the support assembly to selectively change a tilting angle of the backrest with respect to the support assembly;

a slide movably fit over a portion of the support assembly and pivoted to the backrest, the slide further comprising fastening means to selectively secure the slide with respect to the support assembly thereby releasably securing the tilting angle of the backrest with respect to the support assembly; and a movement limiter connecting between the slide and the portion of the support assembly to limit the movement of the slide with respect to the support assembly to a predetermined range;

wherein the movement limiter comprises a wire connected between the slide and the support assembly, the wire having a predetermined length to prevent the slide from separation from the support assembly.

11. A chair comprising:

a support assembly comprising legs adapted to position on a fixed surface;

a backrest having lower ends pivoted to the support assembly whereby the backrest is rotatable with respect to the support assembly to selectively change a tilting angle of the backrest with respect to the support assembly;

a slide movably fit over a portion of the support assembly and pivoted to the backrest, the slide further comprising fastening means to selectively secure the slide with respect to the support assembly thereby releasably securing the tilting angle of the backrest with respect to the support assembly; and an automatic returning mechanism arranged between the backrest and the support assembly, which, after the backrest is moved with respect to the support assembly from a first tilting angle to a second tilting angle, helps returning the second tilting angle back to the first tilting angle.

12. The chair as claimed in claim 11, wherein the returning mechanism comprises a resilient member between the slide and the portion of the support assembly that induces a tensile force when the backrest is moved to the second tilting angle, the tensile force driving the backrest from the second tilting angle back tilting angle when the backrest is released from the second tilting angle.

13. The chair as claimed in claim 12, wherein the resilient member comprises a helical spring having opposite ends attached to the slide and the support assembly respectively.

* * * * *